US009322406B2

(12) United States Patent
Potratz

(10) Patent No.: US 9,322,406 B2
(45) Date of Patent: Apr. 26, 2016

(54) LIGHTWEIGHT INFLATION DEVICE

(76) Inventor: Robert Stephen Potratz, Overland Park, KS (US)

( * ) Notice: Subject to any disclaimer, the term of this patent is extended or adjusted under 35 U.S.C. 154(b) by 1336 days.

(21) Appl. No.: 12/957,115

(22) Filed: Nov. 30, 2010

(65) Prior Publication Data

US 2011/0129369 A1 Jun. 2, 2011

Related U.S. Application Data

(60) Provisional application No. 61/265,163, filed on Nov. 30, 2009.

(51) Int. Cl.

| | |
|---|---|
| ***F04D 19/00*** | (2006.01) |
| ***F04D 29/54*** | (2006.01) |
| ***F04D 25/08*** | (2006.01) |
| ***F04D 25/06*** | (2006.01) |
| ***F04D 29/52*** | (2006.01) |

(52) U.S. Cl.

CPC ..... *F04D 19/002* (2013.01); *F04D 25/084* (2013.01); *F04D 29/522* (2013.01); *F04D 29/542* (2013.01); *F04D 25/0673* (2013.01)

(58) Field of Classification Search

CPC ... F04D 13/06; F04D 13/068; F04D 25/0673; F04D 25/08; F04D 25/084; F04D 29/002; F04D 29/403; F04D 29/40; F04D 29/522; F04D 29/54; F04D 29/541; F04D 29/542; F04D 29/544; F04D 29/545; F04D 29/60; F04D 29/601; F04D 29/64; F04D 29/644; F04D 29/646; F04D 3/00; F04D 19/002; F04D 29/181; F04D 29/321; F04D 29/325; F04D 29/52–29/566

USPC ..... 417/48, 234, 411, 423.14, 572, 408, 417/423.1; 5/713; 137/223; 141/67

See application file for complete search history.

(56) References Cited

U.S. PATENT DOCUMENTS

| | | | | |
|---|---|---|---|---|
| 4,389,166 | A * | 6/1983 | Harvey et al. | 417/234 |
| 4,678,014 | A | 7/1987 | Owen et al. | |
| 5,890,882 | A * | 4/1999 | Feldman | 417/411 |
| 6,237,653 | B1 * | 5/2001 | Chaffee | 141/313 |
| 6,296,459 | B1 * | 10/2001 | Saputo et al. | 417/423.14 |
| 7,025,576 | B2 * | 4/2006 | Chaffee | 417/366 |

(Continued)

OTHER PUBLICATIONS

Compressor Performance,Aerodynamic for the user;second edition;M.Theodore Gresh;pp. 39-42.*

(Continued)

*Primary Examiner* — Alexander Comley

(74) *Attorney, Agent, or Firm* — David M. Pankros, Attorney at Law

(57) ABSTRACT

A lightweight inflation device for outputting a low-pressure airflow to inflate an air bladder includes a body defining an airflow chamber and a plurality of air manipulation elements disposed within the airflow chamber. At least one of the air manipulation elements is a rotor including a plurality of blades, and the inflation device includes a driving mechanism operable to rotate the blades about an axis. The inflation device further includes a nozzle operably coupled with the body and defining an air outlet to connect with a valve on the air bladder. The nozzle is shiftable into an operating position in which the air outlet extends beyond an outlet-side axial margin of the body. The nozzle is also shiftable into a storage position in which the air outlet is disposed within the airflow chamber of the body. A method of inflating an air bladder with a portable axial compressor assembly is also disclosed.

14 Claims, 5 Drawing Sheets

(56) References Cited

U.S. PATENT DOCUMENTS

| | | | | |
|---|---|---|---|---|
| 2004/0256018 | A1* | 12/2004 | Ikemoto et al. | 138/126 |
| 2007/0163441 | A1* | 7/2007 | Tao et al. | 96/121 |
| 2008/0003111 | A1* | 1/2008 | Turan | 417/234 |
| 2008/0099074 | A1* | 5/2008 | Peterson | 137/236.1 |
| 2008/0135151 | A1* | 6/2008 | Loewe | 152/419 |

OTHER PUBLICATIONS

Presently available information page for prior art product commercially available from Coleman (publication date unknown, printed from the web on Apr. 28, 2011, available at http://www.meijer.com/s/coleman-4d-deluxe-quickpump-green/__/R-79988).

* cited by examiner

LIGHTWEIGHT INFLATION DEVICE

CROSS-REFERENCE TO RELATED APPLICATION

The present application claims the benefit of and priority from U.S. Provisional Patent Application Ser. No. 61/265,163, filed Nov. 30, 2009, the entire disclosure of which is hereby incorporated by reference herein.

BACKGROUND OF THE INVENTION

1. Field of the Invention

The present invention relates generally to a lightweight inflation device. More specifically, the present invention concerns a portable axial compressor assembly adapted to output a low-pressure airflow for efficiently inflating an air bladder.

2. Discussion of the Prior Art

Those of ordinary skill in the art will appreciate that various inflatable devices are available that require inflation of an air bladder for use. Some particular examples of such inflatable devices that are particularly relevant for the field of the present invention include sleeping pads, ultralight air mattresses, pillows, or other articles that may be commonly used during backpacking, camping, or other remote outdoor activities.

Known devices and methods for filling such inflatable articles with air include both manually-driven as well as powered pumping devices, or simply blowing into an air bladder to inflate by mouth. Manually-driven pumping devices, such as bellows-style compression sacks, are often large enough to move a significant volume of air with each manual compression of the sack, making such devices somewhat unwieldy and difficult to transport. Powered pumping devices, such as popular centrifugal pumps, frequently include a large and heavy electric motor to run the pump, consuming significant electrical energy and often requiring access to a standard electrical outlet or a large battery pack.

While such conventional devices and methods for inflation have been satisfactory in some respects, those of ordinary skill in the art will also appreciate that known options have also presented drawbacks in both convenience and portability. Such drawbacks are particularly appreciable in the fields of backpacking, camping, or other remote outdoor activities, where access to standard electrical outlets is often non-existent and the weight of large motors and/or battery packs makes transport impractical.

SUMMARY

The present invention provides a lightweight inflation device in the form of a portable axial compressor assembly that is adapted to output a low-pressure airflow for efficiently inflating an air bladder. The inflation device is particularly advantageous for quickly and easily inflating an air bladder of a sleeping pad, ultralight air mattress, pillow, or other article that may be commonly used during backpacking, camping, or other outdoor activities. The invention provides a compact and lightweight inflation device that is easily portable, suitable for carrying in a backpack, and conserves the energy used by a driving power source.

In particular, when the inventive device is driven by an electric motor powered by batteries, the high-efficiency operation allows the pump to have a long battery life between charging or replacing the batteries. Not only does such efficiency provide greater convenience for a user in not having to frequently swap batteries, but the longer battery life also saves weight and waste in the outdoors. The unique inflation device is lighter, smaller, and more efficient than prior art compressors, and is easier and safer than inflating an air bladder by mouth.

According to one aspect of the present invention, a portable axial compressor assembly is provided that is adapted to output a low-pressure airflow for inflating an air bladder. The axial compressor assembly includes a body that defines a generally cylindrical, elongated airflow chamber and that includes a central axis extending therethrough. The body presents an inlet-side axial margin and an opposite outlet-side axial margin. The compressor assembly also includes a plurality of air manipulation elements that are disposed within the airflow chamber and axially in line with one another. The plurality of air manipulation elements includes a first stator and a rotor. The first stator is disposed generally adjacent the inlet-side axial margin and includes a first plurality of substantially radially-extending fixed vanes. The rotor is disposed generally inboard of the first stator and includes a plurality of radially-extending rotatable blades. The compressor assembly further includes a driving mechanism that drivingly engages the rotor to cause the rotor to rotate about the axis, and a nozzle that is operably coupled with the body to define an air outlet adapted to connect with a valve on the air bladder. The nozzle is shiftable into an operating position in which the air outlet extends beyond the outlet-side axial margin of the body.

Another aspect of the present invention concerns a method of inflating an air bladder with a portable axial compressor assembly that is adapted to output a low-pressure airflow. The method includes the steps of opening a shiftable cover that is disposed generally adjacent an outlet-side axial margin of a body of the compressor assembly to thereby activate a driving mechanism to drive at least one air manipulation element for outputting the low-pressure airflow, extending a collapsible nozzle into an operating position in which an air outlet defined by the nozzle is disposed beyond the outlet-side axial margin of the body, and coupling the air outlet of the collapsible nozzle with a valve on the air bladder to inflate the air bladder with the low-pressure airflow.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein:

FIG. 1 is an isometric view of a lightweight inflation device in the form of a portable axial compressor assembly constructed in accordance with the principles of a preferred embodiment of the present invention, with the compressor assembly including a body with a shiftable cover in the form of a hinged door illustrated in a closed position, and with the compressor assembly including a nozzle in a storage position within an airflow chamber of the body;

FIG. 2 is an isometric view of the axial compressor of FIG. 1, shown with the hinged door in an open position, and with the nozzle extended into an operating position in which an air outlet extends beyond an outlet-side margin of the body;

FIG. 3 is a generally isometric, partial sectional view of the axial compressor of FIGS. 1-2, shown with the hinged door in the open position, with the nozzle in the operating position and operably connected with a valve on an air bladder via an outlet adapter, and with portions of the body and of the nozzle being illustrated in sectional view to depict details of air manipulation elements and an electric motor disposed within the airflow chamber of the body;

Figure 2:
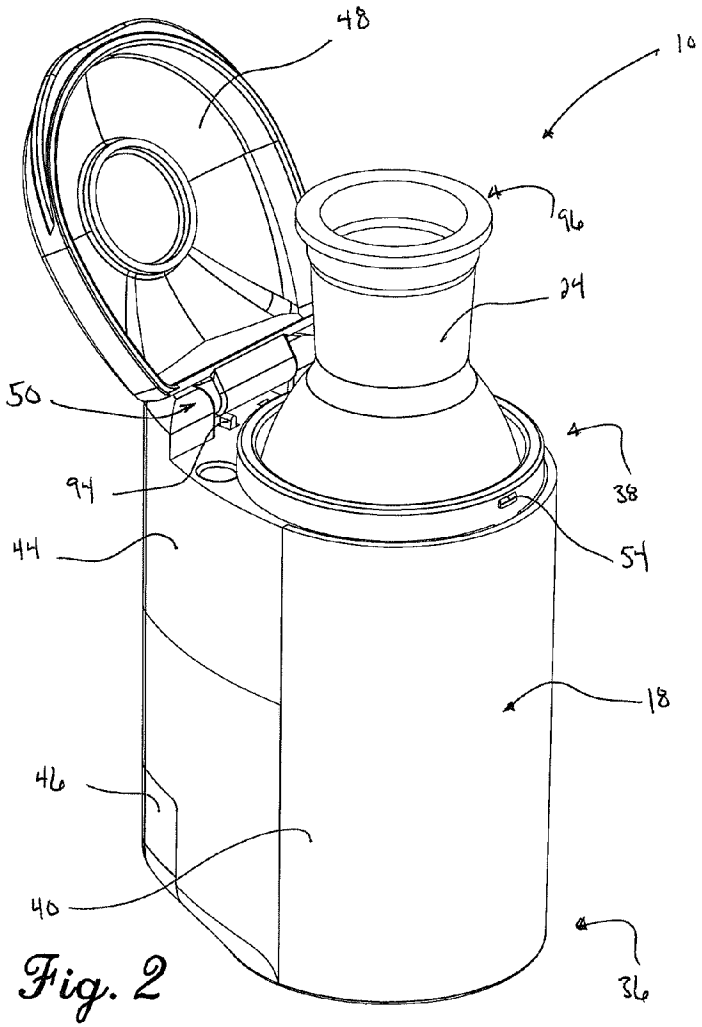
Figure 3:
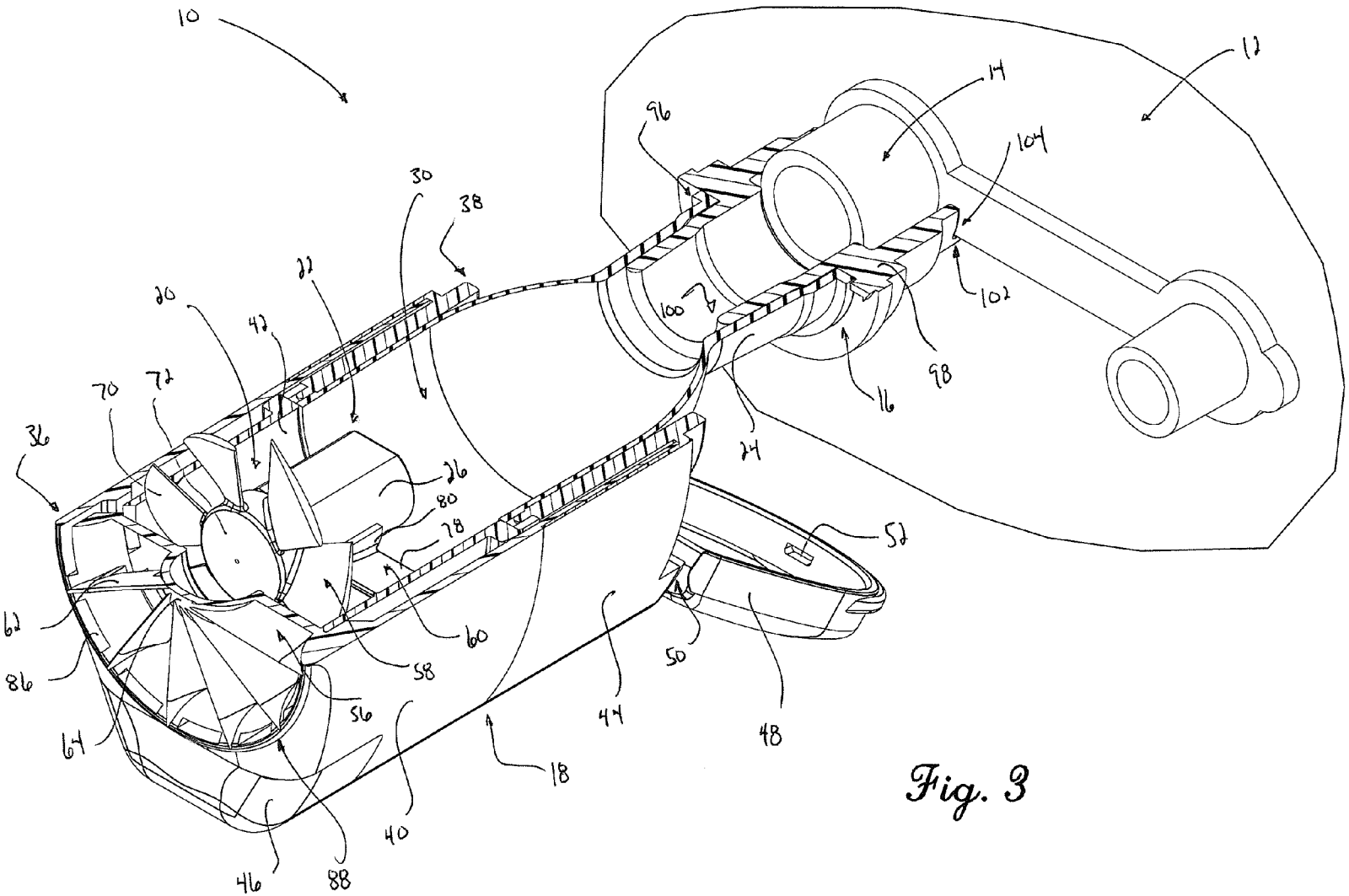
Figure 4:
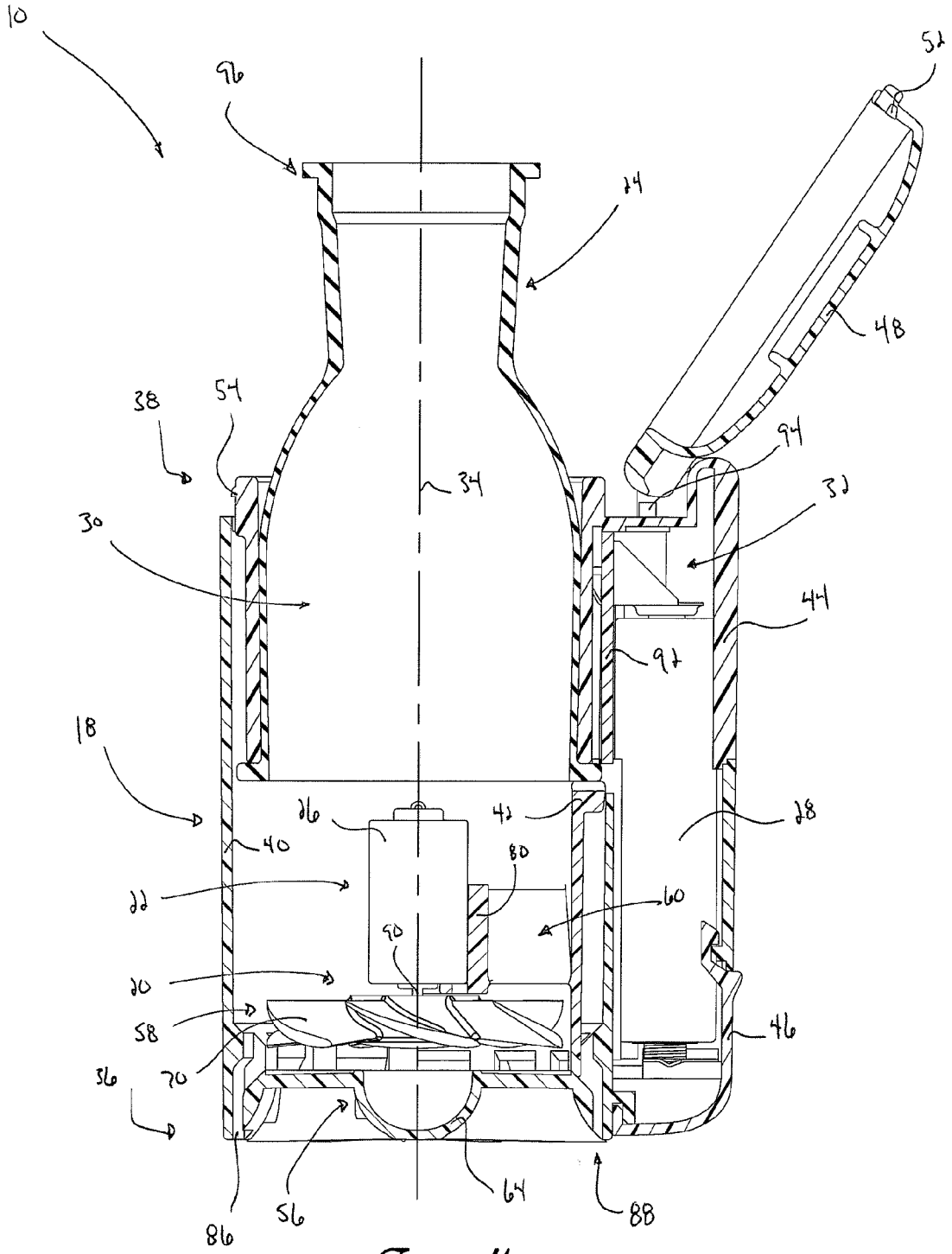
FIG. 4 is a generally side elevational, partial sectional view of the axial compressor of FIGS. 1-3, shown with the hinged door in the open position, with the nozzle in the operating position, and with portions of the body and of the nozzle being illustrated in sectional view to depict details of elements disposed within the airflow chamber and within a battery chamber of the body.
Figure 5:
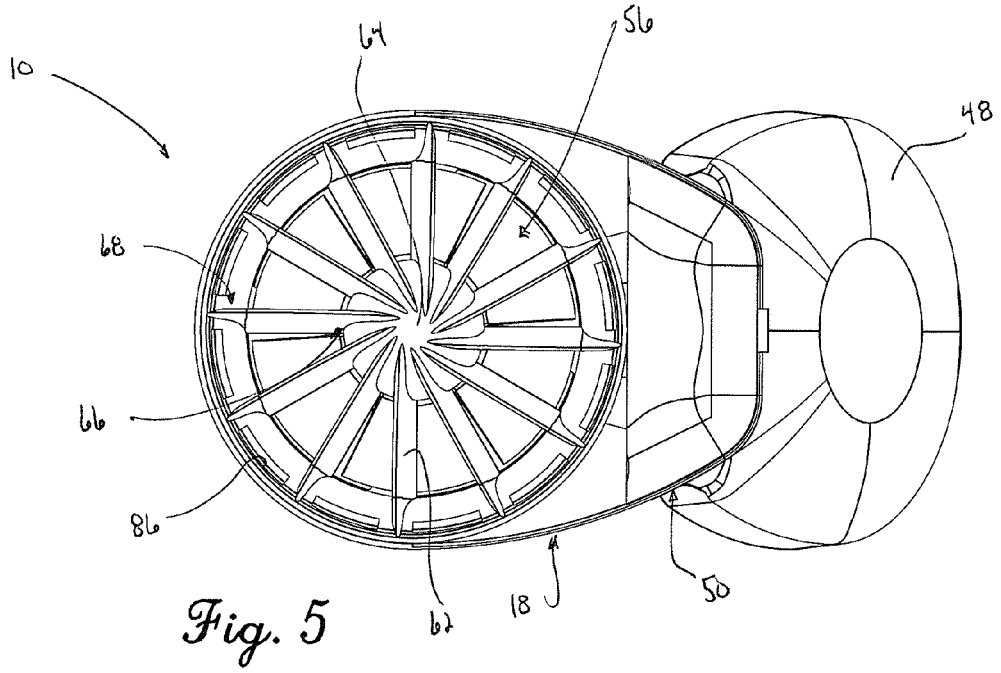
FIG. 5 is an end elevational view of the axial compressor of FIGS. 1-4, shown with the hinged door in the open position, particularly depicting a first stator disposed generally adjacent an inlet-side margin of the body and a plurality of pressure-relief vents disposed generally about a radially outer periphery of the airflow chamber of the body.
Figure 6:
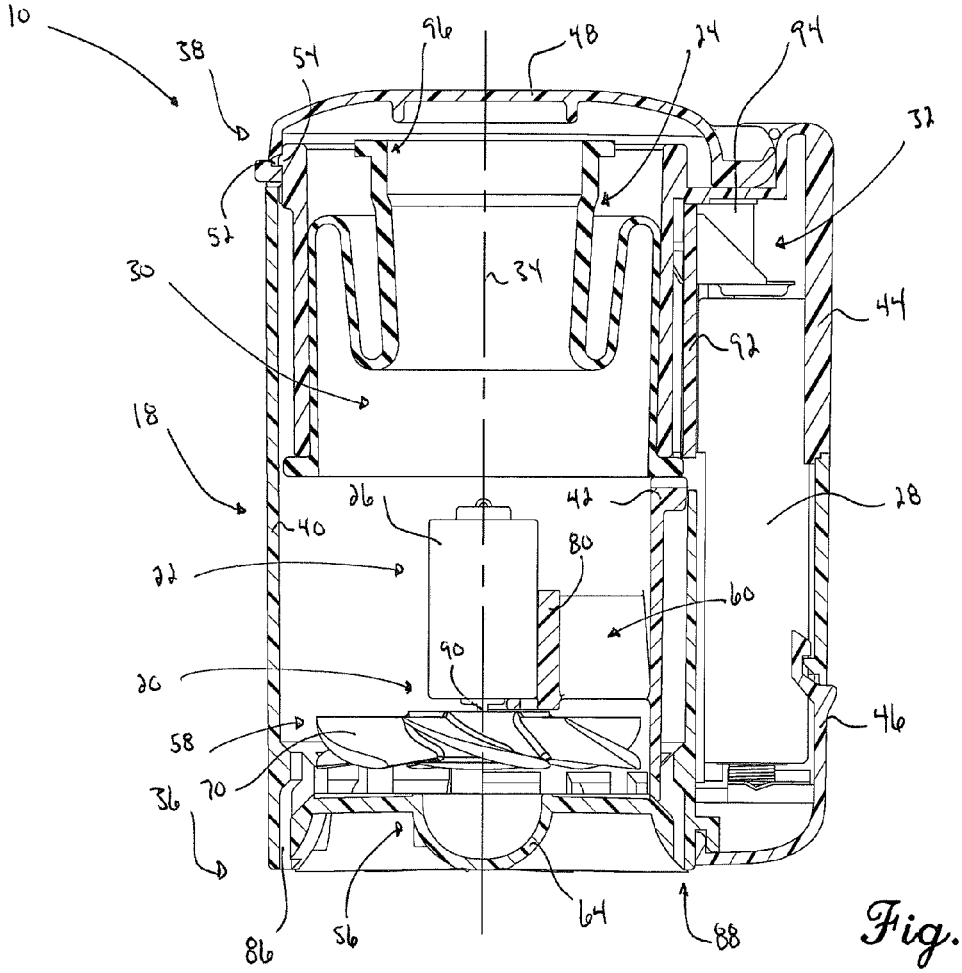
Figure 7:
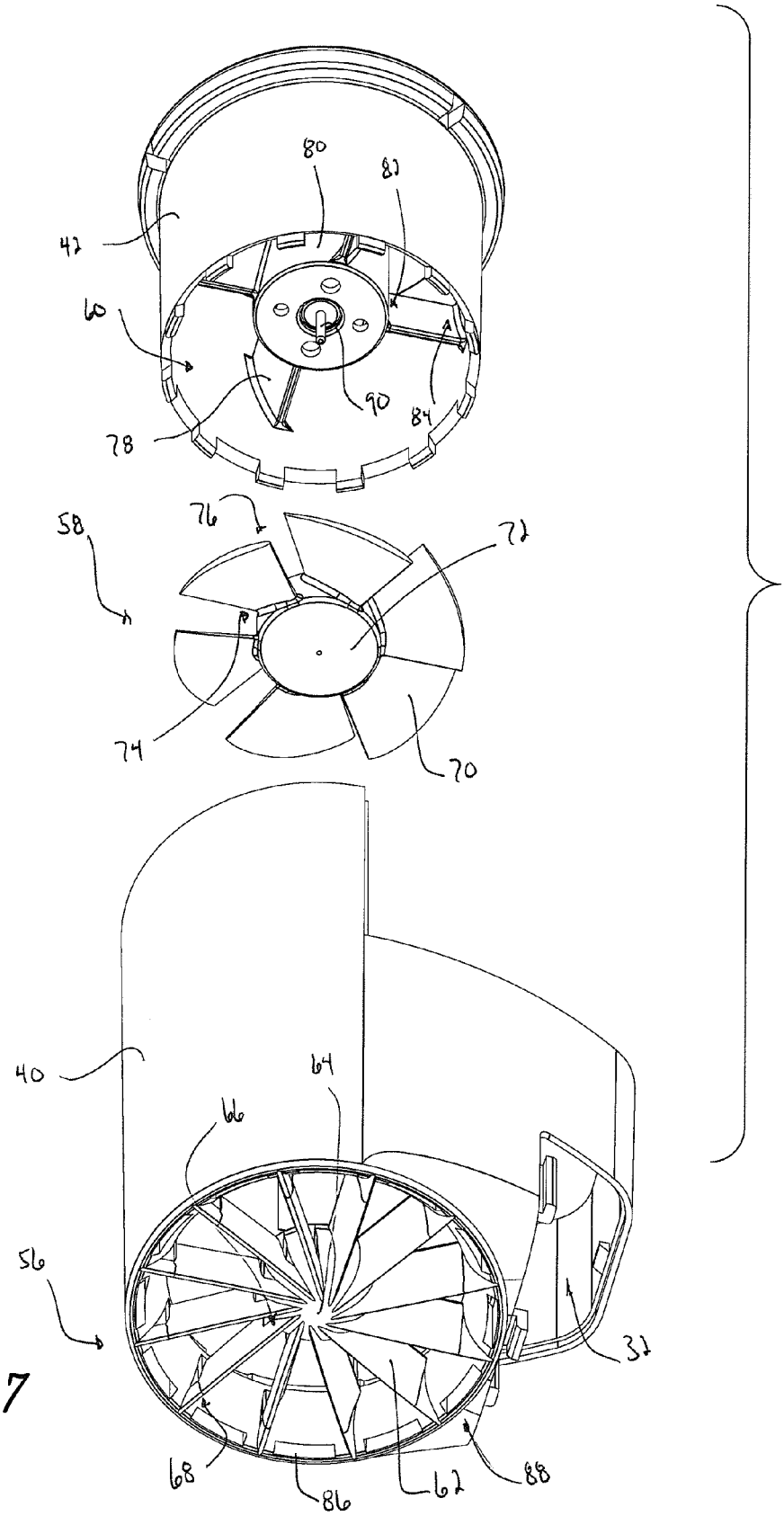

FIG. 6 is a generally side elevational, partial sectional view of the axial compressor of FIGS. 1-5, similar in many respects to the view of FIG. 4, but shown with the hinged door in the closed position, with the nozzle collapsed in the storage position, and with portions of the body and of the nozzle being illustrated in sectional view to depict details of elements disposed within the airflow camber and within the battery chamber of the body; and FIG. 7 is an exploded view of a portion of the axial compressor of FIGS. 1-6, particularly depicting body components and details of air manipulation elements including the first stator including fixed vanes, a rotor including rotatable blades, and a second stator including fixed vanes cooperatively supporting the electric motor.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 1:
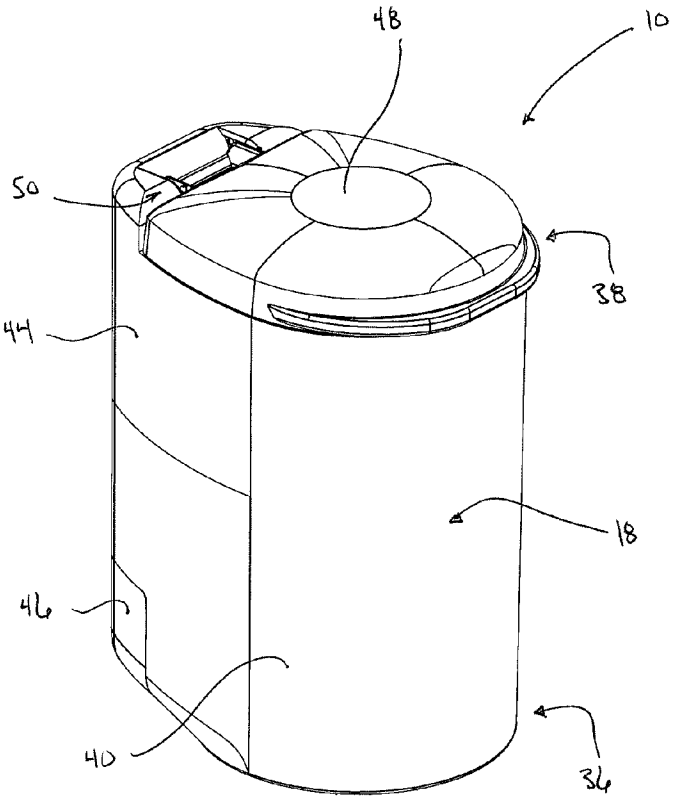

With initial reference to FIGS. 1-3, a portable axial compressor assembly 10 constructed in accordance with the principles of an embodiment of the present invention is depicted for use in various applications. While the axial compressor assembly 10 is useful in various applications, the illustrated embodiment has particular utility when the illustrated axial compressor assembly 10 is adapted to output a low-pressure airflow for filling inflatable articles, such as sleeping pads, ultralight air mattresses, pillows, or other articles that may be commonly used during backpacking, camping, or other remote outdoor activities.

With specific reference to FIG. 3, the axial compressor assembly 10 is depicted as being operably connected to an air bladder 12 that includes a valve 14, as will be readily appreciated by one of ordinary skill in the art. In the embodiment shown in FIG. 3, the axial compressor assembly 10 is operably connected to the valve 14 via a generally annular outlet adapter 16, as is described in detail below.

With attention still to FIGS. 1-3, the axial compressor assembly 10 broadly includes a body 18, a group of air manipulation elements 20, a driving mechanism 22, and a nozzle 24. As described in detail below, and with brief reference to FIGS. 4 and 6, the driving mechanism 22 of the illustrated embodiment includes an electric motor 26 and an electrical charge source in the form of user-replaceable batteries 28 that are in electrical communication with the electric motor 26.

Returning now to FIGS. 1-3, and with continued reference to FIGS. 4 and 6, the body 18 broadly defines an airflow chamber 30 and a battery chamber 32. Preferably, although not necessarily, the airflow chamber 30 and the battery chamber 32 are separate from one another, as is depicted in the illustrated embodiment. As shown in FIGS. 4 and 6, the airflow chamber 30 is generally cylindrical and elongated, with a central axis 34 extending therethrough. As also shown in FIGS. 4 and 6, the batteries 28 are disposed within the battery chamber 32, as will be readily appreciated by one of ordinary skill in the art upon review of this disclosure.

The body 18 presents an inlet-side axial margin 36 and an opposite outlet-side axial margin 38. In more detail, and as shown particularly in FIGS. 3, 4, 6, and 7, the body 18 is cooperatively formed of a plurality of body components 40, 42, 44. In addition, the body 18 includes a battery compartment door 46 configured to provide user access to the battery chamber 32, as is generally conventional in the art.

The body 18 also includes a shiftable cover in the form of a hinged door 48 that is shiftable into and out of a closed position in which the door 48 is disposed generally adjacent the outlet-side axial margin 38 in a generally covering relationship therewith. In more detail, FIG. 1 illustrates the door 48 in the closed position, while FIG. 2 illustrates the door 48 having been moved out of the closed position into an open position.

In the illustrated embodiment, the door 48 is swingably movable between the open and closed positions about a hinge 50 disposed generally adjacent the outlet-side axial margin 38 of the body 18, as described in further detail below. Moreover, the hinged door 48 includes a latching notch 52 that cooperates with a corresponding latching nub 54 on the body component 44, so that the door 48 can be latched shut and secured in the closed position, as will be readily appreciated by one of ordinary skill in the art. It is noted that although the shiftable cover is depicted in the form of the hinged door 48, alternative shiftable covers (not shown) may take other forms, such as a removable cap or a sliding door, without departing from the teachings of the present invention.

The body 18 of the illustrated embodiment is formed of a synthetic resin material. In more detail, the body components 40, 42, 44, as well as the battery compartment door 46 and the hinged door 48, are formed by injection molding a plastic material. The material and formation process of the body components 40, 42, 44, the battery compartment door 46, and the hinged door 48 described herein, provide the body 18 with sufficient structural strength for operation, while remaining extremely lightweight. The body components 40 and 44 are secured together with conventional fasteners, such as screws (not shown) as will be readily appreciated by one of ordinary skill in the art upon review of this disclosure.

Turning specifically now to FIGS. 3-7, additional structural details of the depicted group of air manipulation elements 20 will be described. In the illustrated embodiment, the plurality of air manipulation elements 20 broadly includes a first stator 56, a rotor 58, and a second stator 60. These air manipulation elements 20, the first stator 56, the rotor 58, and a second stator 60, are disposed within the airflow chamber 30 and are axially in line with one another.

Looking initially at the first stator 56, the first stator 56 is disposed generally adjacent the inlet-side axial margin 36 and includes a first plurality of substantially radially-extending fixed vanes 62. In the illustrated embodiment, each of the first plurality of fixed vanes 62 extends generally radially outwardly from a common hub 64 disposed along the axis 34.

In more detail, the depicted first stator 56 includes a first plurality of twelve (12) fixed vanes 62, with each of the first plurality of fixed vanes 62 presenting an airfoil profile. In even more detail, each of the first fixed vanes 62 defines an angle of attack along a radially inner margin 66 of the vane 62 adjacent the hub 64 of less than approximately eight degrees (8°), and an angle of attack along a radially outer margin 68 of the vane 62 of approximately ten degrees) (10°). As will be readily understood by one of ordinary skill in the art upon review of this disclosure and the accompanying drawing figures, each fixed vane 62 smoothly lofts between the attack angles of the radially inner margin 66 and the radially outer margin 68.

In the illustrated embodiment, the first stator 56 is integrally formed with the body component 40, although such integration is not required. Additionally, the first stator 56 may include more or fewer fixed vanes 62 than the depicted twelve (12) fixed vanes 62 without departing from the teachings of the present invention. Furthermore, it is noted that alternative first fixed vanes (not shown) may be "straight" vanes having an angle of attack of zero degrees (0°) and/or "flat" vanes lacking an airfoil profile.

Finally, it is specifically noted that an alternative first stator (not shown) may simply comprise a "grate" or grid pattern of fixed vanes, without any fixed vanes extending radially outwardly from a common central hub. So long as such a grate includes fixed members that are at least substantially radially-extending (even if substantially radially-extending as chords without passing through a central hub), then the grate would serve as a first stator and remain firmly within the ambit of the present invention.

Looking next at the rotor 58, the rotor 58 is disposed generally inboard of (axially inwardly of) the first stator 56 and includes a plurality of radially-extending rotatable blades 70. In the illustrated embodiment, each of the plurality of rotatable blades 70 extends radially outwardly from a common central portion 72 disposed along the axis 34.

In more detail, the depicted rotor 58 includes a plurality of six (6) rotatable blades 70, with each of the plurality of rotatable blades 70 presenting an airfoil profile. In even more detail, each of the rotatable blades 70 defines an angle of attack along a radially inner margin 74 of the blade 70 adjacent the central portion 72 of approximately thirty degrees (30°), and an angle of attack along a radially outer margin 76 of the blade 70 of approximately fifteen degrees (15°). As will be readily understood by one of ordinary skill in the art upon review of this disclosure and the accompanying drawing figures, each rotatable blade 70 smoothly lofts between the attack angles of the radially inner margin 74 and the radially outer margin 76.

As will be readily appreciated, the rotor 58 may include more or fewer rotatable blades 70 than the depicted six (6) rotatable blades 70 without departing from the teachings of the present invention. Furthermore it is noted that alternate attack angles and/or blade profiles may be selectively incorporated while remaining within the ambit of the present invention, depending on the desired performance of the compressor, as will be readily understood by one of ordinary skill in the art.

As described in detail below, the rotor 58 is rotated about the axis 34 by operable driving engagement between the rotor 58 and the electric motor 26 (or other suitable driving mechanism; not shown).

Looking next at the depicted second stator 60, the second stator 60 is disposed generally inboard of (axially inwardly of) the rotor 58 and includes a second plurality of substantially radially-extending fixed vanes 78. In the illustrated embodiment, each of the second plurality of fixed vanes 78 extends generally radially outwardly from a common support ring 80 disposed centrally about the axis 34.

In more detail, the depicted second stator 60 includes a second plurality of four (4) fixed vanes 78, with each of the second plurality of fixed vanes 78 presenting a generally "flat" profile. In even more detail, each of the second fixed vanes 78 defines a generally constant angle of attack between a radially inner margin 82 of the vane 78 adjacent the support ring 80 and a radially outer margin 84 of the vane 78 of less than approximately thirty degrees (30°).

In the illustrated embodiment, the second stator 60 is integrally formed with the body component 42, although such integration is not required. Additionally, the second stator 60 may include more or fewer fixed vanes 78 than the depicted four (4) fixed vanes 78 without departing from the teachings of the present invention. Furthermore, it is noted that alternative second fixed vanes (not shown) may be "straight" vanes having an angle of attack of zero degrees (0°) and/or vanes presenting an airfoil profile.

Finally, the body 18 defines a plurality of pressure-relief vents 86 disposed generally about a radially outer periphery 88 of the inlet-side margin 36. In the illustrated embodiment, the pressure-relief vents 86 are defined by the body component 40, and serve to fluidly communicate between the airflow chamber 30 and an ambient environment outside of the compressor assembly 10.

It is noted that the pressure-relief vents 86 are disposed radially outwardly from the blade outer margins 76 of the blades 70 of the rotor 58 (see FIGS. 4-6). It is believed that the pressure-relief vents 86 provide an alternative air passageway during operation such that back pressure buildup within the airflow chamber 30 is prevented. In the illustrated embodiment, the body component 40 defines twelve (12) pressure-relief vents 86, with each pressure-relief vent 86 being defined within circumferential spaces between adjacent ones of the fixed vanes 62.

As discussed briefly above, and with continued reference to FIGS. 4 and 6, the driving mechanism 22 of the illustrated embodiment includes the electric motor 26 and the electrical charge source in the form of user-replaceable batteries 28 that are in electrical communication with the electric motor 26. The electric motor 26 is in operable driving engagement with the rotor 58 for causing the rotor 58 to rotate about the axis 34 when electrical power is supplied to the motor 26 from the batteries 28.

In the illustrated embodiment, the electric motor 26 is disposed within the airflow chamber 30 of the body 18 and includes a drive shaft 90 disposed along the axis 34. The electric motor 26 is secured within the support ring 80 in a conventional manner, such as with an adhesive (not shown), with the support ring 80 and the second plurality of fixed vanes 78 providing sufficient radial support for the electric motor 26 within the airflow chamber 30. The rotor 58, and in particular the common central portion 72 of the rotor 58, is coupled with the drive shaft 90 and is configured to rotate with the drive shaft 90 when the electric motor is receiving power, as will be readily understood by one of ordinary skill in the art.

In the depicted embodiment, the electric motor 26 comprises a twelve millimeter (12 mm), three volt (3 V), direct current (DC) motor. The electric motor 26 is driven with approximately five hundred milliamps (500 mA) of current at a rotational speed of approximately eighteen thousand to twenty thousand revolutions per minute (18,000-20,000 RPM) to produce approximately four to five gram-centimeters (4-5 g·cm) of torque at a maximum motor efficiency of greater than fifty percent (50%).

Also in the depicted embodiment, the electrical charge source in the form of batteries 28 in electrical communication with the electric motor 26 are preferably, although not necessarily, lithium-based non-rechargeable batteries (size AAA), which advantageously provide long life and low weight. It is noted, of course, that other electrical charge sources, including alkaline batteries, rechargeable batteries, and the like, may be alternatively incorporated without departing from the teachings of the present invention.

The operating parameters of the electric motor 26 are controlled with a computing device in the form of a printed circuit board (PCB) 92. The printed circuit board 92 is coupled with the electric motor 26 and with the batteries 28 for electrical communication therewith, and is disposed within the battery chamber 32 of the body 18 (see FIGS. 4 and 6). The printed circuit board 92 includes a push-button switch 94 operable to permit or prevent the flow of electrical energy from the batteries 28 to the electric motor 26, so as to be operable to turn the electric motor 26 on or off based upon the position of the push-button switch 94.

In the illustrated embodiment, the push-button switch 94 is configured so that when the push-button switch 94 is engaged, the electric motor 26 is turned off (and the rotor 58 does not rotate), and when the push-button switch 94 is released, the electric motor 26 is turned on (and the rotor 58 rotates about the axis 34). In more detail, as shown particularly in FIGS. 4 and 6, the push-button switch 94 is disposed along the outlet-side axial margin 38 such that the push-button switch 94 is released when the hinged door 48 is in the open position (see FIG. 4) and is engaged by a portion of the hinged door 48 when the hinged door 48 is in the closed position (see FIG. 6).

In this way, the electric motor 26 (and thereby the compressor assembly 10) is turned on by opening the hinged door 48, and the electric motor 26 (and thereby the compressor assembly 10) is turned off by closing the hinged door 48, as will be readily understood by one of ordinary skill in the art upon review of this disclosure. Therefore, if the compressor assembly 10 is packed in a snug-fitting container, such as a stuff sack (not shown) for backpacking, then the electric motor 26 (and thereby the compressor assembly 10) is prevented from being accidentally turned on.

It will be readily appreciated by one of ordinary skill in the art that additional components (not shown), particularly electric components such as lamps, light emitting diodes (LEDs), and the like, may selectively incorporated into suitable portions of the body 18. Any selected electric components may be powered by the batteries 28. Such additional components may be controlled by the push-button switch 94 or by additional controls (not shown) on the printed circuit board 92. It is specifically noted that the selective inclusion of such additional components shall remain firmly within the ambit of the present invention.

Turning specifically now to FIGS. 1-4 and 6, additional structural details of the depicted nozzle 24 will be described. In the illustrated embodiment, a portion of the nozzle 24 is coupled with the body 18 and defines an air outlet 96 adapted to connect with the valve 14 on the air bladder 12 to be inflated. The depicted nozzle 24 is shiftable into and out of an operating position in which the air outlet 96 extends beyond the outlet-side axial margin 38 of the body 18 (see FIGS. 2-4). The depicted nozzle 24 is also shiftable into and out of a storage position in which the air outlet 96 is disposed within the airflow chamber 30 of the body 18 (see FIGS. 1 and 6).

The nozzle 24 of the illustrated embodiment is generally resiliently deformable so as to be axially collapsible (e.g., retracted) into the storage position (see FIGS. 1 and 6). The generally resiliently deformable nature of the nozzle 24 allows the nozzle 24 to "snap" back into place when the nozzle 24 is moved (e.g., extended) from the storage position into the operation position (see FIGS. 2-4), as will be readily understood by one of ordinary skill in the art upon review of this disclosure. The depicted nozzle 24 is formed of a silicon rubber material.

Preferably, although not necessarily, the nozzle 24 presents a generally radially-converging cross-section from a coupled portion thereof adjacent the outlet-side axial margin 38 of the body 18 down to the air outlet 96 when the nozzle 24 is in the operation position (see FIGS. 2-4). Additionally, the air outlet 96 of the illustrated nozzle 24 is at least slightly radially expandable so as to be operably connectable with a variety of valve shapes of different air bladders to be inflated, as will be readily appreciated by one of ordinary skill in the art upon review of this disclosure.

Finally, with quick reference specifically to FIG. 3, it is noted that the generally annular outlet adapter 16 includes a generally rigid body 98 that presents a first axial margin 100 configured to be snugly received within the air outlet 96 of the nozzle 24, and an opposite second axial margin 102 configured to engage the valve 14 of the air bladder 12 to be inflated. In more detail, the second axial margin 102 also defines an air passage port 104 that is held open by the shape of the generally rigid structure of the body 98 of the outlet adapter 16, which may ensure proper inflation of the air bladder 12 with the low-pressure axial compressor assembly 10.

With general reference to FIGS. 1-7, additional structural and operational details of the depicted axial compressor assembly 10 will be described. The axial compressor assembly 10 of the illustrated embodiment presents an axial length dimension of less than about four inches (4"), and the generally cylindrical airflow chamber 30 presents a diameter dimension of less than about one and one-half inches (1.5"). In more detail, the axial compressor assembly 10 of the illustrated embodiment presents an axial length dimension of less than about four inches (4") when the axial compressor assembly 10 in the open position with the nozzle 24 extended in the operation position (see FIGS. 2-4), but presents an axial length dimension of less than about three inches (3") when the axial compressor assembly 10 in the closed position with the nozzle 24 retracted in the storage position (see FIGS. 1 and 6). Therefore, retraction and storage of the shiftable nozzle 24 of the present invention reduces the overall axial length dimension of the axial compressor assembly 10 by approximately twenty-five percent (25%), allowing for more compact storage or packing.

Additionally, the axial compressor assembly 10 of the illustrated embodiment presents a total weight (including the batteries 28) of less than approximately two and one-half ounces (2.5 oz). In even more detail, some embodiments of the axial compressor assembly 10 present a total weight (including the batteries 28) of less than approximately two and one-fifth ounces (2.2 oz). The depicted low-pressure axial compressor assembly 10 is configured to output a maximum airflow pressure through the air outlet 96 of less than approximately one-tenth of one pounds per square inch (0.1 psi) above ambient during operation. In even more detail, the extreme low-pressure axial compressor assembly 10 is configured to output a maximum airflow pressure through the air outlet 96 of less than approximately five-hundredths of one pounds per square inch (0.05 psi) above ambient during operation.

It is believed that the relatively small size of the axial compressor assembly 10, and/or the operation of the axial compressor assembly 10 at such low pressures, allows the axial compressor assembly 10 to adequately and satisfactorily inflate the air bladder 12 while minimizing the amount of electrical power required for operation compared with traditional compressors. In more detail, the axial compressor assembly 10 as depicted and described herein is configured to consume less than approximately two watts (2.0 w) of electrical power during operation, yielding a significant advantage in reduced power consumption and higher efficiency compared with conventional known compressors. In even more detail, some embodiments of the axial compressor assembly 10 are configured to consume less than approximately one and one-half watts (1.5 w) of electrical power during operation, yielding an even greater advantage in reduced power consumption and high efficiency compared with conventional known compressors.

Lastly, operation of the axial compressor assembly 10 and a method of inflating the air bladder 12 therewith should be readily apparent from the foregoing description and, therefore, will be described here only briefly. In one particular method of inflating, the hinged door 48 of the body 18 is opened to thereby turn on the electric motor 26 and to drive the rotor 58 for outputting low-pressure airflow.

The collapsible nozzle 24 is extended into the operating position in which the air outlet 96 is disposed beyond the outlet-side axial margin 38 of the body 18. The nozzle 24 may be pulled from the storage position in which the air outlet 96 is disposed within the airflow chamber 30 of the body 18 to at least temporarily resiliently deform the nozzle 24 during extension thereof into the operating position.

The air outlet 96 is then operably coupled with the valve 14 of the air bladder 12 to inflate the air bladder 12 with the low-pressure airflow. The outlet adapter 16 may be optionally inserted into the valve 14 of the air bladder 12 to hold the valve 14 open, with the air outlet 96 being coupled with the outlet adapter 16 to inflate the air bladder 12 with the low-pressure airflow.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and access the reasonably fair scope of the present invention as pertains to any apparatus not materially departing from but outside the literal scope of the invention set forth in the following claims.

What is claimed is:

1. A portable axial compressor assembly adapted to output a low-pressure airflow for inflating an air bladder, said axial compressor assembly comprising:

a body defining a cylindrical, elongated airflow chamber and including a central axis extending therethrough, said body presenting an inlet-side axial margin, and an opposite outlet-side axial margin, and a shiftable cover;

a plurality of air manipulation elements disposed within the airflow chamber and axially in line with one another, said plurality of air manipulation elements comprising a first stator and a rotor, said first stator being disposed within the body and including a first plurality of substantially radially-extending fixed vanes, said rotor being disposed between the first stator and a second stator and including a plurality of radially-extending rotatable blades;

a driving mechanism drivingly engaging the rotor for causing the rotor to rotate about the axis, said driving mechanism comprising an electric motor, an electrical charge source in electrical communication with the electric motor, and a switch operable to permit or prevent the flow of electrical energy from the electrical charge source to the electric motor so as to turn to the electric motor on or off; and a nozzle operably coupled with the body and defining an air outlet adapted to connect with a valve on the air bladder, said blades having an angle of attack between zero and thirty degrees, said nozzle being shiftable into an operating position in which the air outlet extends beyond the outlet-side axial margin of the body said shiftable cover being shiftable into and out of a closed position in which the cover is disposed adjacent the outlet-side axial margin in a covering relationship therewith, and said shiftable cover being configured to engage the switch when in the closed position such that the motor is turned off when the cover is in the closed position, and to release the switch when moved out of the closed position such that the motor is turned on when the cover is out of the closed position.

2. The axial compressor assembly as claimed in claim 1, said body being formed of a synthetic resin material.

3. The axial compressor assembly as claimed in claim 1, said axial compressor assembly presenting an axial length dimension of less than about four inches.

4. The axial compressor assembly as claimed in claim 1, said axial compressor assembly presenting a weight of less than approximately two and one-half ounces.

5. The axial compressor assembly as claimed in claim 4, said axial compressor assembly being configured to output an airflow pressure through the air outlet of less than approximately one-tenth of one pounds per square inch above ambient during operation.

6. The axial compressor assembly as claimed in claim 5, said axial compressor assembly being configured to consume less than approximately one and one-half watts of electrical power during operation.

7. The axial compressor assembly as claimed in claim 1, said cover comprising a hinged door such that the cover swings into and out of the closed position about a hinge disposed adjacent the outlet-side axial margin, said body including a latch such that the hinged door is latched shut when in the closed position.

8. The axial compressor assembly as claimed in claim 7, said body being formed of a synthetic resin material.

9. The axial compressor assembly as claimed in claim 7, said axial compressor assembly presenting an axial length dimension of less than about four inches.

10. The axial compressor assembly as claimed in claim 7, said axial compressor assembly presenting a weight of less than approximately two and one-half ounces.

11. The axial compressor assembly as claimed in claim 10, said axial compressor assembly being configured to output an airflow pressure through the air outlet of less than approximately one-tenth of one pounds per square inch above ambient during operation.

12. The axial compressor assembly as claimed in claim 11, said axial compressor assembly being configured to consume less than approximately one and one-half watts of electrical power during operation.

13. The axial compressor assembly as claimed in claim 1; and an outlet adaptor configured to hold open the valve on the air bladder and to snugly couple with the air outlet.

14. A portable axial compressor assembly adapted to output a low-pressure airflow for inflating an air bladder, said axial compressor assembly comprising:

a body defining a cylindrical, elongated airflow chamber and including a central axis extending therethrough, said body presenting an inlet-side axial margin and an opposite outlet-side axial margin, said body defining a plurality of pressure-relief vents disposed about a radially outer periphery of the inlet-side margin, said pressure-relief vents fluidly communicating between the airflow chamber and ambient such that backpressure buildup within the airflow chamber is prevented;

a plurality of air manipulation elements disposed within the airflow chamber and axially in line with one another, said plurality of air manipulation elements comprising a first stator and a rotor, said first stator being disposed within the body and including a first plurality of substantially radially-extending fixed vanes, said rotor being disposed between the first stator and a second stator and including a plurality of radially-extending rotatable blades;

a driving mechanism drivingly engaging the rotor for causing the rotor to rotate about the axis; and a nozzle operably coupled with the body and defining an air outlet adapted to connect with a valve on the air bladder, and said first plurality of substantially radially-extending fixed blades presenting an airfoil profile, said nozzle being shiftable into an operating position in which the air outlet extends beyond the outlet-side axial margin of the body.

* * * * *